US009962817B2

(12) United States Patent
Schultz

(10) Patent No.: US 9,962,817 B2
(45) Date of Patent: May 8, 2018

(54) TOOL FOR HAMMER UNION

(71) Applicant: Timothy Schultz, Bonnyville (CA)

(72) Inventor: Timothy Schultz, Bonnyville (CA)

( * ) Notice: Subject to any disclaimer, the term of this patent is extended or adjusted under 35 U.S.C. 154(b) by 310 days.

(21) Appl. No.: 14/990,625

(22) Filed: Jan. 7, 2016

(65) Prior Publication Data

US 2017/0197301 A1 Jul. 13, 2017

(51) Int. Cl.
*B25B 21/02* (2006.01)
*B25B 13/08* (2006.01)
*B25B 13/50* (2006.01)

(52) U.S. Cl.
CPC ..... *B25B 21/02* (2013.01); *B25B 13/08* (2013.01); *B25B 13/50* (2013.01)

(58) Field of Classification Search
CPC ..... B25B 13/08; B25B 13/50; B25B 21/02; B25B 21/005; E21B 19/163
See application file for complete search history.

(56) References Cited

U.S. PATENT DOCUMENTS 6,279,427 B1 * 8/2001 Francis ..... B25B 21/005 81/57.39
7,059,424 B2 * 6/2006 Neal ..... B25B 13/48 173/104
9,109,727 B1 8/2015 Madson
9,782,876 B2 * 10/2017 Francis ..... B25B 21/005
2005/0279196 A1 * 12/2005 Hollar ..... B25B 21/005 81/464
2012/0048069 A1 * 3/2012 Powell, Jr. ..... B25B 13/04 81/124.2
2015/0231768 A1 8/2015 Francis et al.
2017/0050302 A1 * 2/2017 Borders ..... B25B 13/48

OTHER PUBLICATIONS

The Weir Group PLLC, "Safety Hammer", downloaded from www.weiroilandgas.com on Aug. 21, 2015, p. 1.

* cited by examiner

*Primary Examiner* — David B Thomas
(74) *Attorney, Agent, or Firm* — Seed IP Law Group LLP

(57) ABSTRACT

A tool for tightening and loosening a pipe fitting, comprising a cup-shaped tool head having an opening for receiving a pipe and a shaft attached to and extending from the tool head. The tool head has an interior surface adapted for a pipe fitting such that the pipe fitting may rotate with respect to the tool head. The shaft is shaped to receive a pneumatic hammer. The pneumatic hammer has a hammer head, and the hammer head in operation extends into the interior of the tool head to act on a wing of the pipe fitting.

14 Claims, 2 Drawing Sheets

TOOL FOR HAMMER UNION

TECHNICAL FIELD

Tools and, more particularly, a tool for tightening and loosening hammer unions.

BACKGROUND

Hammer unions are commonly used in the petroleum industry to join piping together, such as for example piping carrying high-pressure fluids. In order to tighten or loosen a hammer union, workers typically will strike the small wings of a hammer union multiple times using a sledge hammer. This practice is dangerous to the worker and may result in damage to the hammer union. Repeated strikes to the wings of a hammer union may result in breakage of the wings and sending of shrapnel which may injure the worker or other nearby team members.

SUMMARY

A pneumatic hammer may be used instead of a sledge hammer to tighten and loosen hammer unions, but it may be difficult to safely positioning and stabilizing the pneumatic hammer.

In an embodiment, there is provided a tool for tightening and loosening a pipe fitting, comprising a cup-shaped tool head having an opening for receiving a pipe; a shaft attached to and extending from the tool head; the tool head having an interior shaped to enclose a wing of a pipe fitting such that the pipe fitting may rotate within the tool head; and the shaft shaped to receive a pneumatic hammer, the pneumatic hammer having a hammer head, the hammer head in operation extending into the interior of the tool head to act on a wing of a pipe fitting.

In an embodiment, there is provided a tool for tightening and loosening a pipe fitting, comprising a cup shaped housing adapted to receive a pipe fitting, such that the pipe fitting may rotate within the housing; a handle attached to the housing, the handle having an interior channel for receiving a pneumatic hammer, the interior channel aligning with a gap in the housing to provide a confined passageway for the pneumatic hammer to contact a wing of a pipe fitting; and the housing having circumferential ends forming an opening adapted to receiving a pipe.

In various embodiments, there may be included any one or more of the following features: each wing of the pipe fitting extends to the interior surface; the pneumatic hammer is removably received in the shaft; the tool head is C-shaped; the interior surface forms at least a 180 degree arc around the pipe fitting; the interior surface forms at least a 270 degree arc around the pipe fitting; the pipe fitting is a hammer union; the shaft is attached at an angle of 30-60 degrees relative to a radial line; the shaft is positioned between 120 and 140 degrees from the opening of the tool head; the tool head further comprises a backing attached to an edge of the interior surface; the backing is adapted to receive a portion of a pipe fitting; the interior channel is reduced in diameter in proximity to the opening.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims. In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

Figure 1:
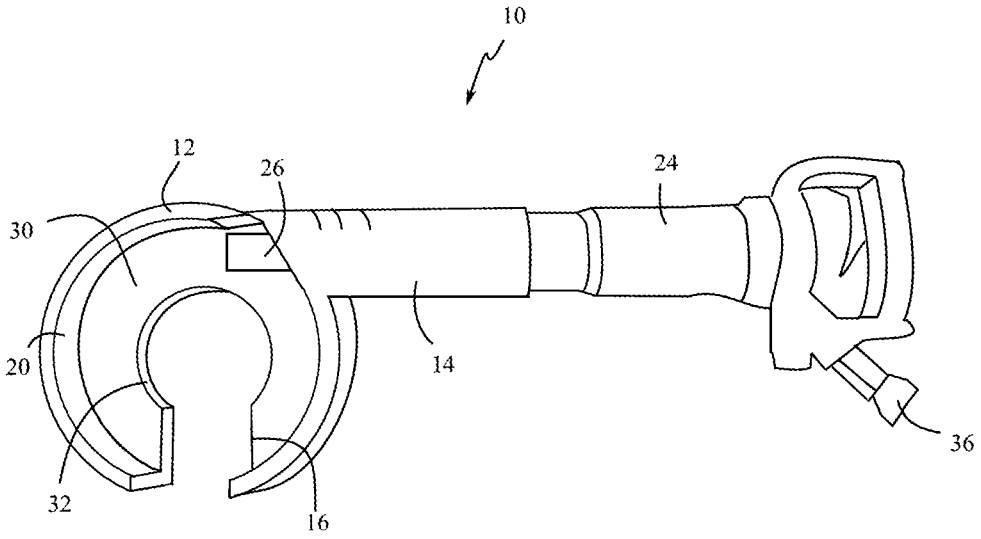
FIG. 1 is a perspective view of an embodiment of a tool.
Figure 2:
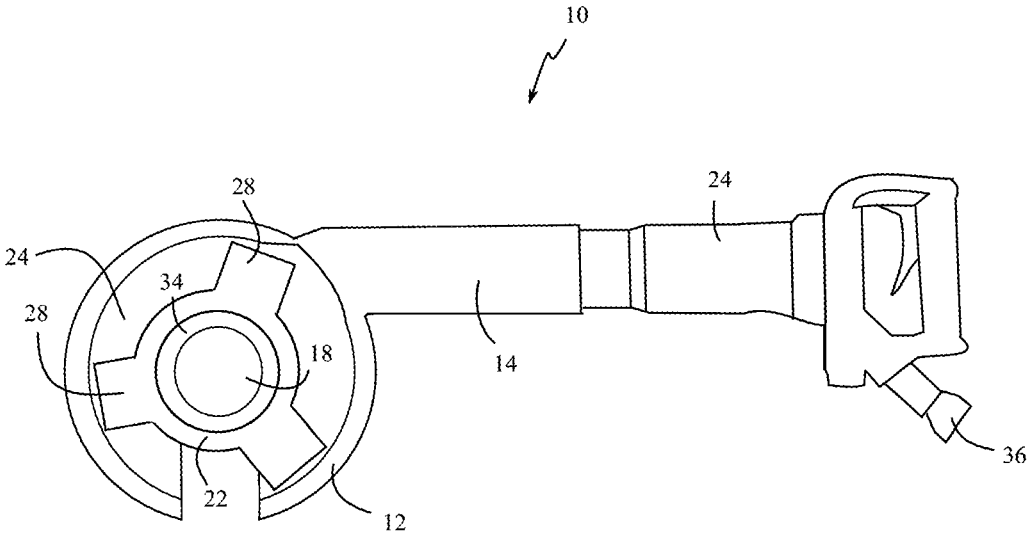
FIG. 2 is a top view of the tool of FIG. 1 attached to a hammer union.

FIGS. 1 and 2 show an embodiment of a tool 10. The tool 10 has a cup-shaped tool head 12 and a shaft 14 attached to and extending from the tool head 12. The tool head has an opening 16 for receiving a pipe 18.

As shown in FIG. 2, the tool head 12 may have an interior surface 20 adapted for a pipe fitting 22 such that the pipe fitting 22 may rotate with respect to the tool head 12. The tool head 12 may be circular in shape. The shaft 14 may be shaped to receive a pneumatic hammer 24. The pneumatic hammer 24 may have a hammer head 26 which in operation extends into the interior of the tool head 12.

The tool head 12 may be positioned on a pipe fitting 22 as shown in FIG. 2, by inserting or sliding a pipe 18 attached to the pipe fitting 22 through opening 16. The pipe fitting 22 may have wings 28 which may extend to the interior surface 20 when the tool head 12 is positioned around a pipe fitting 22. The interior surface 20 may be shaped to enclose a pipe fitting 22, and may form a solid wall around a portion of the pipe fitting 22. There may be a certain degree of space between the wall of the interior surface 20 and the wings 28 to facilitate the rotation of the wings 28 within the tool head 12.

The pipe fitting may be in the form of a hammer union. A hammer union may have three equally spaced wings 28 which in typical use would provide a surface for a worker to strike with a sledge hammer to tighten or loosen the hammer union. However, it is possible to use tool 10 with a hammer union having more or fewer wings. Each of the hammer union wings may have a generally rectangular or square cross-section.

The cup-shape of the tool head 12 allows the tool 10 to be readily moved into position around pipe fitting 22. The tool head 12 may be a C-shaped cup. The interior surface 20 may form at least a 180 degree arc around the pipe fitting in order to provide stability and protection from the action of the pneumatic hammer 24. The interior surface 20 may form at least a 270 degree arc around the pipe fitting 22 to provide greater coverage and stability.

The tool head 12 may have a backing 30 attached to an edge of interior surface 20. The backing 30 may have an interior edge 32 forming a circular opening which may be sized to receive a pipe 18 or portion of a pipe fitting 22, such as for example a male or female portion 34 of a hammer union. The interior surface 20 may be larger in diameter than the width of the opening 16 for receiving pipe 18, and may be centered relative to the backing 30.

In operation, air may be drawn into the pneumatic hammer 24 through tube 36 through operation of the pneumatic hammer 24, to cause the hammer head 26 to move from an initial position within the shaft 14 to a second position inside the tool head 12 (the movement is exaggerated in the drawings, in practice the hammer head has a reciprocating movement that repeatedly hits the wings of the hammer union to rotate the hammer union). The second position may be seen in FIG. 1. The tool 10 may be placed in a position to enable to the hammer head 26 to strike a wing 28 of a pipe fitting 22 to rotate the pipe fitting 22. One possible position is shown in FIG. 2.

The interior surface 20 may provide stability and simplify positioning of the tool 10 for loosening and tightening a pipe fitting 22. The interior surface 20 may also reduce the risk of injury to a worker by providing a barrier between the worker and the contact area of the pneumatic hammer 24 and the pipe fitting 22. The backing 30 may provide further stability and protection.

Figure 3:
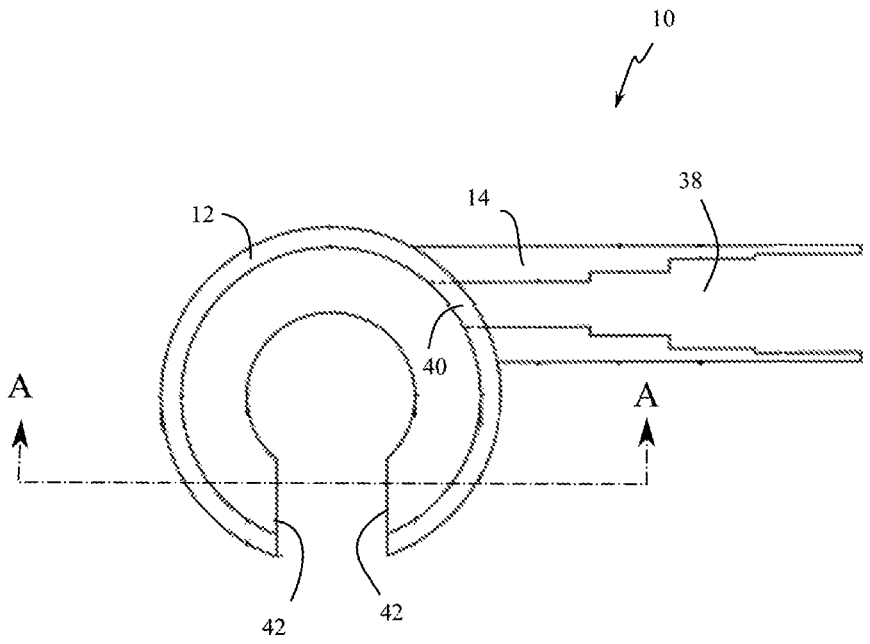
FIG. 3 is a top view of an embodiment of a tool.
Figure 4:
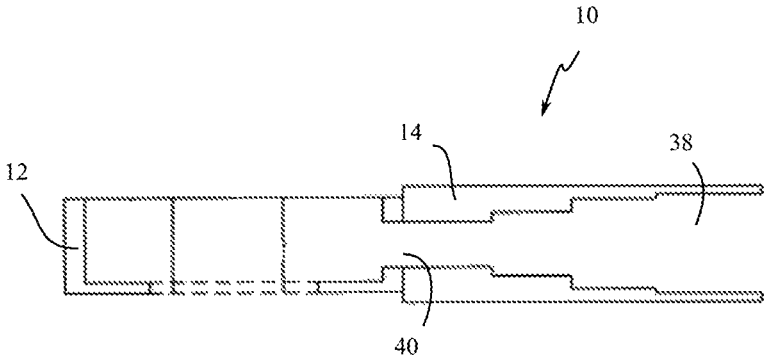
FIG. 4 is a sectional view taken along the line A-A of the tool of FIG. 3.

FIGS. 3 and 4 show the tool 10 comprising a cup shaped tool head or housing 12 adapted to receive a pipe fitting 22, such that the pipe fitting 22 may rotate within the housing 12. A shaft or handle 14 is attached to the housing 12, the handle 14 having an interior channel 38 for receiving a pneumatic hammer 24, the interior channel 38 aligning with a gap 40 in the housing to provide a confined passageway for the pneumatic hammer 24 to contact a wing of a pipe fitting 22; and the housing 12 having circumferential ends 42 forming an opening adapted to receiving a pipe.

The tool 10 may be made of any stable material, for example hardened steel, cast iron, titanium or the like. The tool head 12 may be attached to the shaft 14 by conventional methods, and may for example be countersunk or forged to the tool head 12, or threadably attached. The shaft 14 may be positioned between 80 and 100 degrees from the opening of the tool head 12.

The tool 10 may be sized to fit pipe fittings 22 of various sizes. The opening formed by interior edge 32 may for example be 2 to 7 inches in diameter. The interior surface 20 may for example be 4 to 10 inches in its inner diameter. The opening 16 or the space between circumferential ends 42 may for example be 2 to 7 inches wide. The interior surface 20 may for example be 0.3 to 2 inches in radial wall thickness and 1.5 to 3 inches in width.

As shown in FIGS. 3 and 4, the interior channel 38 may be reduced in diameter in proximity to the gap 40. The diameter of the interior channel 38 may be reduced in steps, such that the diameter size is the same for a certain longitudinal portion of the interior channel 38. For example, the interior channel 38 may have steps having respective longitudinal length and diameter size of 2-3 inches and 2-3 inches; 1.5-2.5 inches and 1.5-2.5 inches; 1.3-2.2 inches and 1-2 inches; and 1.3-2.2 inches and 0.7-1.5 inches.

The shaft or handle 14 may be attached at an angle of 30-60 degrees relative to a radial line extending through the center of the tool head 12, and the shaft or handle 14 may be positioned between 120 and 140 degrees from the opening 16 of the tool head 12.

What is claimed is:

1. A tool for tightening and loosening a pipe fitting, comprising:

a cup-shaped tool head having an opening for receiving a pipe;

a shaft attached to and extending from the tool head;

the tool head having an interior surface adapted for a pipe fitting such that the pipe fitting may rotate with respect to the tool head; and the shaft being shaped to receive a pneumatic hammer, the pneumatic hammer having a hammer head, the hammer head in operation extending into the interior of the tool head to act on a wing of the pipe fitting.

2. The tool of claim 1 wherein each wing of the pipe fitting extends to the interior surface.

3. The tool of claim 1 wherein the tool head is C-shaped.

4. The tool of claim 1 wherein the interior surface forms at least a 180 degree arc around the pipe fitting.

5. The tool of claim 1 wherein the interior surface forms at least a 270 degree arc around the pipe fitting.

6. The tool of claim 1 wherein the pneumatic hammer is removably received in the shaft.

7. The tool of claim 1 wherein the pipe fitting is a hammer union.

8. The tool of claim 1 wherein the shaft is attached at an angle of 30-60 degrees relative to a radial line extending through the center of the tool head.

9. The tool of claim 1 wherein the shaft is positioned between 120 and 140 degrees from the opening of the tool head.

10. The tool of claim 1 wherein the tool head further comprises a backing attached to an edge of the interior surface.

11. The tool of claim 10 wherein the backing is adapted to receive a portion of a pipe fitting.

12. A tool for tightening and loosening a pipe fitting, comprising:

a cup-shaped housing adapted to receive a pipe fitting, such that the pipe fitting may rotate within the housing;

a handle attached to the housing, the handle having an interior channel for receiving a pneumatic hammer, the interior channel aligning with a gap in the housing to provide a confined passageway for the pneumatic hammer to contact a wing of a pipe fitting; and the housing having circumferential ends forming an opening adapted to receive a pipe.

13. The tool of claim 12 wherein the housing is C-shaped.

14. The tool of claim 12 wherein the interior channel is reduced in diameter in proximity to the gap.

* * * * *